US006125965A

United States Patent [19]

Wang

[11] Patent Number: 6,125,965

[45] Date of Patent: Oct. 3, 2000

[54] ACOUSTIC BOARD

[76] Inventor: Chao-Shun Wang, P. O. Box 82-144, Taipei, Taiwan

[21] Appl. No.: 09/411,398

[22] Filed: Oct. 4, 1999

[51] Int. Cl.[7] ..... E04B 1/82

[52] U.S. Cl. ..... 181/286; 181/292; 181/293

[58] Field of Search ..... 181/284, 286, 181/287, 288, 290, 291, 292, 293, 295

[56] References Cited

U.S. PATENT DOCUMENTS 3,887,031 6/1975 Wirt ..... 181/286

5,491,310 2/1996 Jen ..... 181/286

*Primary Examiner*—Khanh Dang

*Attorney, Agent, or Firm*—A & J

[57] ABSTRACT

An acoustic board includes a frame, a plurality of large cups equidistantly fitted in the frame, each of the large cups being a conical member which is open at a large end thereof, a plurality of small cups equidistantly fitted in the frame, each of the small cups being a conical member which is open at a large end thereof, and a front panel mounted on the frame to cover the large ends of the large and small cups, whereby the acoustic board which can effectively isolate the noise from one side to another.

5 Claims, 3 Drawing Sheets

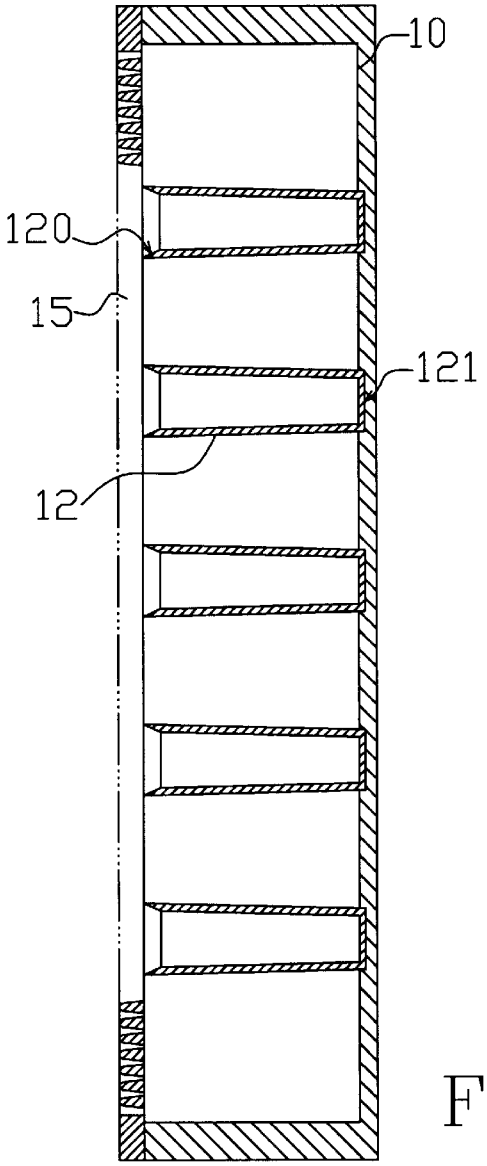
FIG. 3
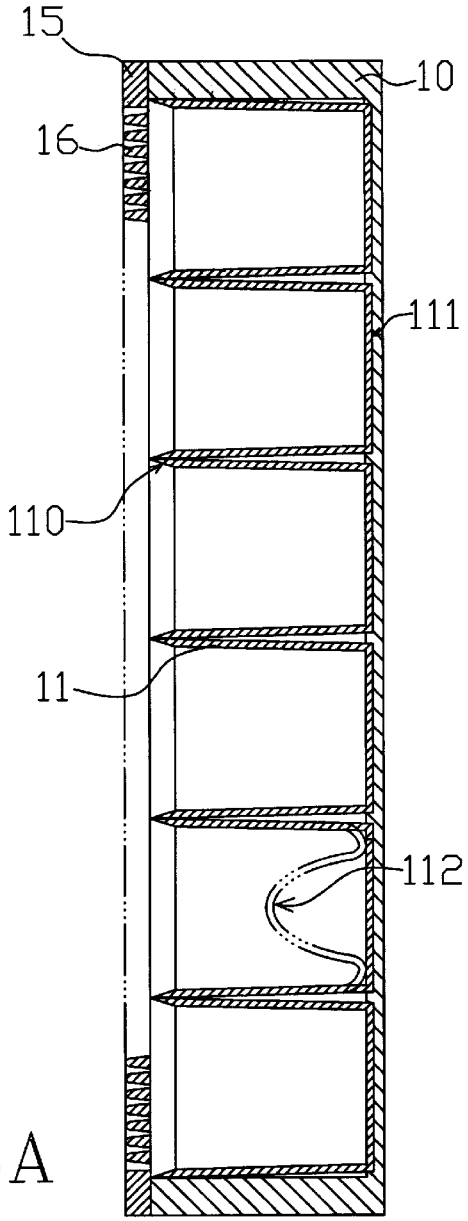
FIG. 4
FIG. 3A
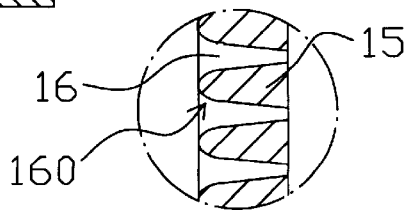

ACOUSTIC BOARD

BACKGROUND OF THE INVENTION

1. Field of the Invention

This invention is related to an improvement in the structure of an acoustic board and in particular to one which can effectively isolate a noise from one side to another.

2. Description of the Prior Art

It has been found that various conventional acoustic boards have been developed to meet the increasing need of isolating a noise from one side to the other. The conventional acoustic board generally includes a frame, two sound collecting boxes disposed within the frame, and a sound isolating plate arranged between the two sound collecting boxes. The sound isolating plate is composed of two honeycomb cores and a partition mounted therebetween, while the sound collecting box is composed of a piece of fire-proof cloth and a perforated board. The fire-proof cloth includes a piece of fire-proof fiber and a sheet of perforated aluminum foil provided at one side with self-adhesive straps. However, such an acoustic board is too complicated in structure thereby making it unfit for practical use.

Therefore, it is an object of the present invention to provide an improved acoustic board which can obviate and mitigate the above-noted drawbacks.

SUMMARY OF THE INVENTION

This invention is related to an improvement in the structure of an acoustic board.

According to a preferred embodiment of the present invention, an acoustic board includes a frame, a plurality of large cups equidistantly fitted in the frame, each of the large cups being a conical member which is open at an large end thereof, a plurality of small cups equidistantly fitted in the frame, each of the small cups being a conical member which is open at an large end thereof, and a front panel mounted on the frame to cover the large ends of the large and small cups.

It is the primary object of the present invention to provide an improved acoustic board which can effectively isolate the noise from one side to another.

It is another object of the present invention to provide an improved acoustic board which is simple in construction.

It is still another object of the present invention to provide an improved acoustic board which is compact in size.

It is still another object of the present invention to provide an improved acoustic board which is low in cost.

It is a further object of the present invention to provide an improved acoustic board which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 3 is a sectional view taken along line 3—3 of FIG. 2;

FIG. 3A is an enlarged fragmentary view of FIG. 3; and

FIG. 4 is a sectional view taken along line 4—4 of FIG. 2.

DETAILED DESCRIPTION OF THE PREFERRED EMBODIMENT

Figure 1:
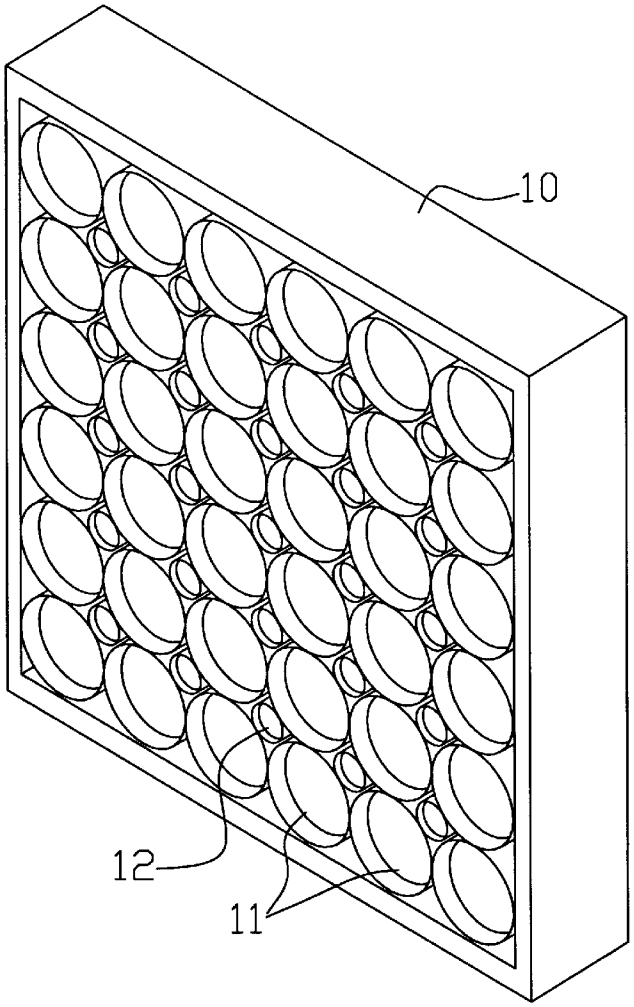
FIG. 1 is a first exploded view of the present invention.
Figure 1:
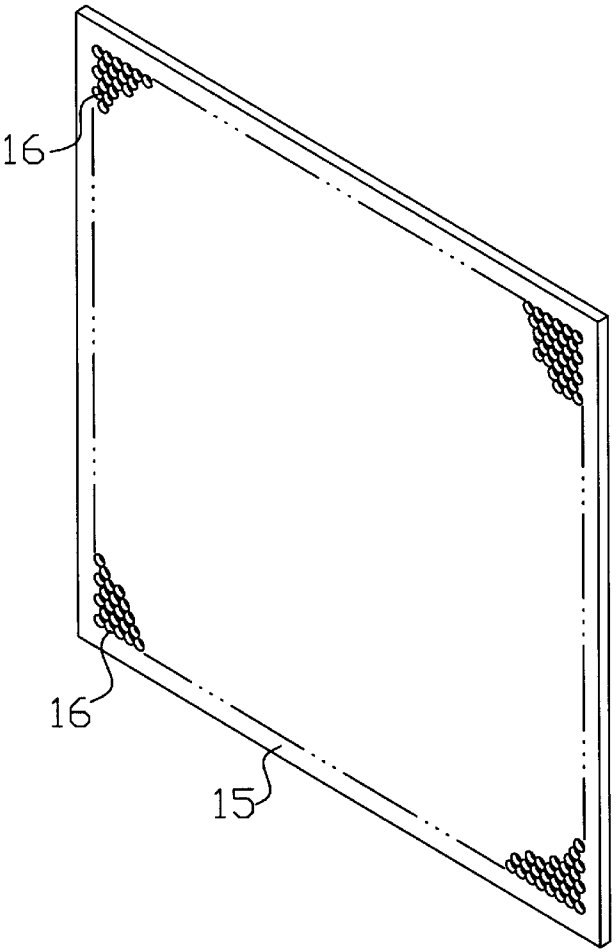

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
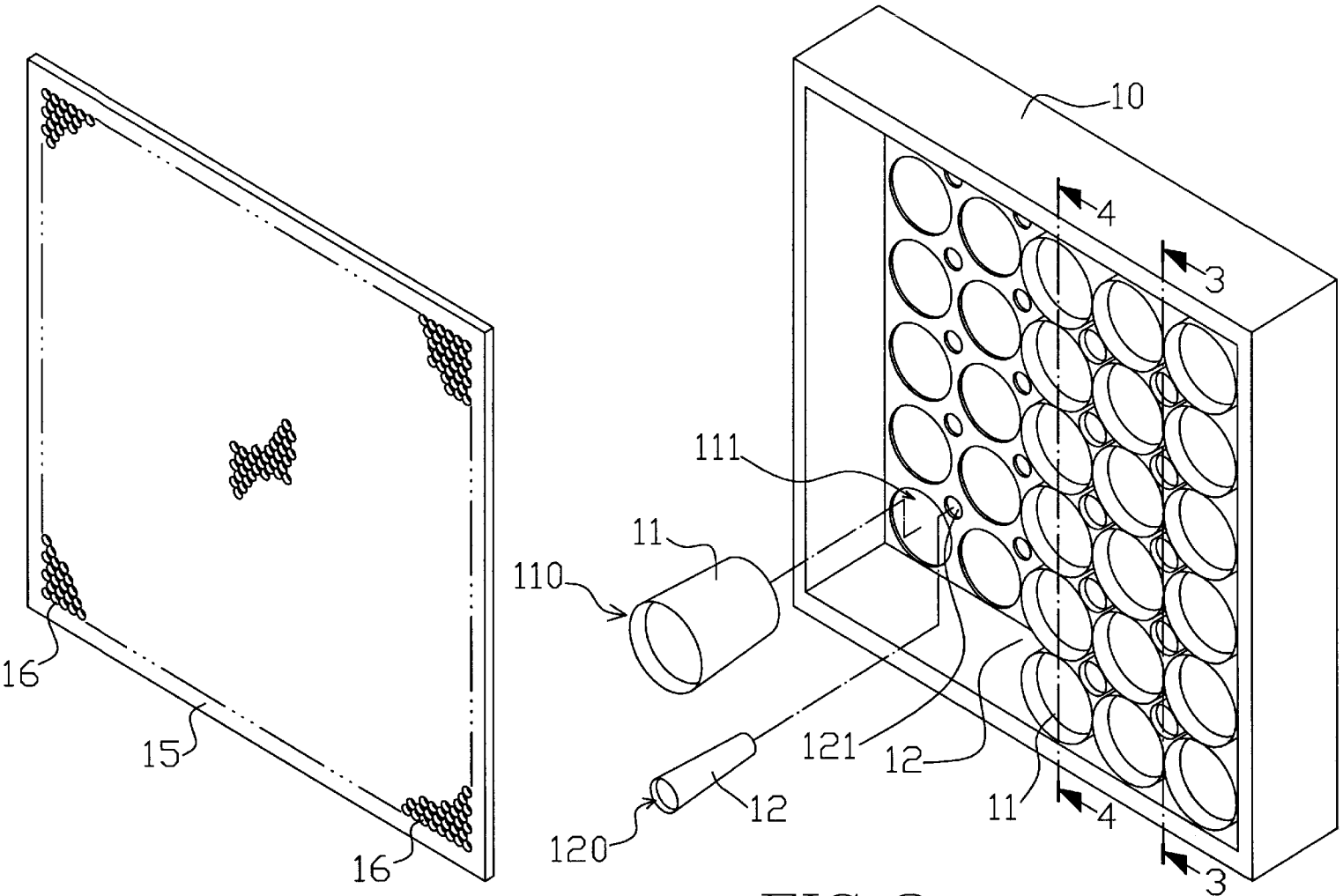
FIG. 2 is a second exploded view of the present invention.

With reference to the drawings and in particular to FIGS. 1 and 2 thereof, the acoustic board according to the present invention generally comprises a rectangular frame 10 and a front panel 15. A plurality of large and small sound collecting cups 11 and 12 which are open at the large end thereof are equidistantly fitted in the rectangular frame 10. The large and small sound collecting cups 11 and 12 may be any arc-shaped geometrical configuration and formed with chamfers 110 and 120 respectively for guiding the noise therein.

The front panel 15 is formed with a plurality of equidistant conical perforations 16 and mounted in the rectangular frame 10 to cover the large and small sound collecting cups 11 and 12. The perforation 16 is formed with a chamber 160 for guiding noise into the large and small sound collecting cups 11 and 12. As noise enters into the large and small sound collecting cups 11 and 12, the noise will be reflected inside the cups 11 and 12 thereby dampening the noise.

Referring to FIG. 4, the bottom of the sound collecting cup 11 may be formed with a smooth projection 112 for enhancing the effect for dampening the noise.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An acoustic board comprising:

a frame;

a plurality of large cups equidistantly fitted in said frame, each of said large cups being a conical member which is open at a large end thereof;

a plurality of small cups equidistantly fitted in said frame, each of said small cups being a conical member which is open at an large end thereof; and a front panel mounted on said frame to cover said large ends of said large and small cups.

2. The acoustic board as claimed in claim 1, wherein said sound collecting cups are chamfered at an open end thereof.

3. The acoustic board as claimed in claim 1, wherein said front panel is formed with a plurality of conical perforations which are chamfered at a large end thereof.

4. The acoustic board as claimed in claim 1, wherein said large and small sound collecting cups may be of any arc-shaped geometrical configuration.

5. The acoustic board as claimed in claim 1, wherein said large sound collecting cups have a bottom formed with a smooth projection.

* * * * *